United States Patent [19]

Edelist

[11] Patent Number: 4,815,510

[45] Date of Patent: Mar. 28, 1989

[54] SECURITY POUCH

[76] Inventor: Maurine S. Edelist, 12647 Albers St., North Hollywood, Calif. 91607

[21] Appl. No.: 170,787

[22] Filed: Mar. 21, 1988

[51] Int. Cl.[4] ..... A45C 1/06; A45C 13/18; A45C 13/30

[52] U.S. Cl. ..... 150/134; 150/143; 150/149; 150/152; 2/113; 2/251; 450/89

[58] Field of Search ..... 150/101, 102, 133, 134, 150/150; 383/38, 86; 2/133, 251; 450/88, 89; 224/222, 182; 206/811; 24/3 R, 3 A, 3 F, 3 M

[56] References Cited

U.S. PATENT DOCUMENTS

| | | | |
|---|---|---|---|
| D. 241,189 | 8/1976 | Clark | 450/89 X |
| 1,183,800 | 5/1916 | Dalitz | 150/134 |
| 1,282,878 | 10/1918 | Lagois | 224/222 X |
| 2,328,095 | 8/1943 | Phillips | 224/222 X |
| 2,439,097 | 4/1948 | Pierce | 2/113 |
| 2,492,862 | 12/1949 | Harvey | 150/101 X |
| 2,503,847 | 4/1950 | Shanahan | 450/89 |
| 2,689,957 | 9/1954 | Fulton | 150/134 X |
| 3,165,135 | 1/1965 | Mintzes et al. | 150/133 |
| 3,311,112 | 3/1967 | Murray | 450/88 X |
| 3,387,641 | 6/1968 | Osborne | 383/38 X |
| 3,459,191 | 8/1969 | Barg | 450/89 |
| 3,670,933 | 6/1972 | Jones | 224/222 |
| 3,938,720 | 2/1976 | Vela | 224/222 |
| 4,201,259 | 5/1980 | Alsdorf | 150/134 |
| 4,286,639 | 9/1981 | Murphy | 383/86 X |
| 4,570,688 | 2/1986 | Williams | 150/134 |

FOREIGN PATENT DOCUMENTS

| | | | |
|---|---|---|---|
| 1052680 | 1/1954 | France | 450/88 |
| 1212945 | 3/1960 | France | 150/134 |
| 324670 | 1/1930 | United Kingdom | 224/222 |

*Primary Examiner*—Sue A. Weaver
*Attorney, Agent, or Firm*—Donald Diamond

[57] ABSTRACT

A security pouch is provided which has an access opening and includes support straps and fasteners for attaching the pouch to a strap of an upper torso undergarment, whereby the pouch is suspendable beneath the arm of a wearer to permit safe, comfortable, inconspicuous and secure carrying of valuables.

11 Claims, 3 Drawing Sheets fig. 4.
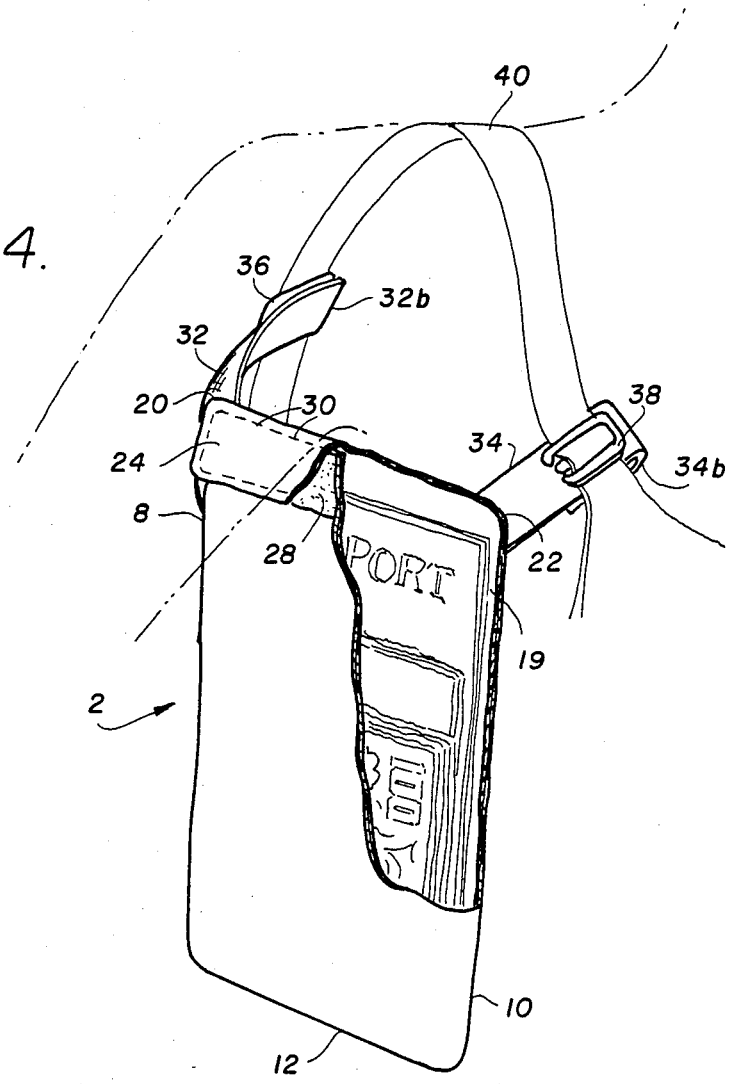
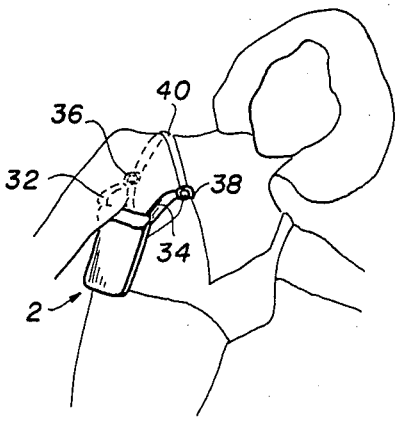
fig. 3.

SECURITY POUCH

BACKGROUND OF THE INVENTION

1. Field of the Invention

This invention relates to carriers for valuables and, more particularly, to a security pouch that is adapted to be attached to an undergarment of a wearer to enable the wearer to carry currency, valuable documents and the like in a concealed manner.

2. Prior Art

It is common for women to carry valuables such as currency, credit cards, driver's license, passport, travelers checks, and the like in purses which may be carried by hand or supported by a shoulder strap. Since these purses are usually carried in plain view, they present an enticing target and are susceptible to being stolen. Money belts, which are adapted to be worn about the waist and below outer attire, have been suggested as a more secure and less conspicuous means for carrying valuables. However, money belts are not particularly suited for use by women because they alter fashion lines and tend to be conspicuous. This is notably the case where the outer garment is a one-piece dress.

SUMMARY OF THE INVENTION

The disadvantages of the prior art are overcome with the present invention that provides a security pouch which is uniquely suited to the needs of women and affords an extremely secure and inconspicuous means for enabling women to carry currency, travelers checks, passports and the like in a safe and concealed manner, while permitting relatively quick and easy access to the valuables when needed.

Accordingly, it is an object of this invention to provide a security pouch which is adapted to be disposed below outer attire in the upper torso region for enabling women to carry valuables securely and inconspicuously.

Another object of this invention is to provide a security pouch of the character described which permits relatively quick and easy access thereto.

A further object of this invention is to provide a security pouch of the character described which does not detract from the comfort or appearance of the user.

A still further object of this invention is to provide a security pouch of the aforesaid character for enabling women to carry valuables safely and securely and which is releasably attachable to a strap of an upper torso undergarment, with the body of the security pouch being suspendable beneath the arm of a wearer to permit safe, inconspicuous and secure carrying of valuables.

The security pouch of this invention is advantageously formed with rectangularly shaped front and rear panels, with each panel, in a preferred embodiment, comprising a laminate having an outer surface of fabric such as cheesecloth and an inner surface of rubber or other water resistant material. The panels, which are joined at their peripheral sides and bottom edges, have cooperatively aligned upper edges that define an access opening. An upward extension of the rear panel, beyond its upper edge, defines a flap member which is foldable about this upper edge so as to releasably secure the access opening. For enhanced utility, first latching means are secured to the inner side of the flap member and second latching means are secured to the outer side of the front panel proximate to the upper edge thereof, with the first and second latching means being releasably interlatchable for releasably securing the flap to the front panel.

First and second elastic support straps are secured to the outer surface of the rear panel at positions proximate to the first and second upper corners, respectively, of this panel. The first and second support straps extend upwardly, outwardly, and, preferably, cross the first and second upper corners, respectively, of the rear panel. A hook is secured to the outer end portion of each support strap, which portion can be a folded segment to provide an enhanced support base for the hook.

The hooks are adapted to releasably engage a strap of an upper torso undergarment as, for example, a brassiere strap wherein one hook engages the strap on the rear side of the shoulder and the other hook engages the strap on the front side of the shoulder, whereby the pouch is suspendable beneath the arm of the wearer to permit safe, inconspicuous and secure carrying of valuables, as well as easy and appropriate access thereto.

DESCRIPTION OF THE DRAWINGS

FIG. 3 is a schematic representation showing the security pouch in use.

FIG. 4 is an enlarged view, similar to FIG. 3, showing the security pouch attached to a strap of an upper torso undergarment and having portions of the pouch broken away to show the contents and details of construction.

DETAILED DESCRIPTION

Figure 1:
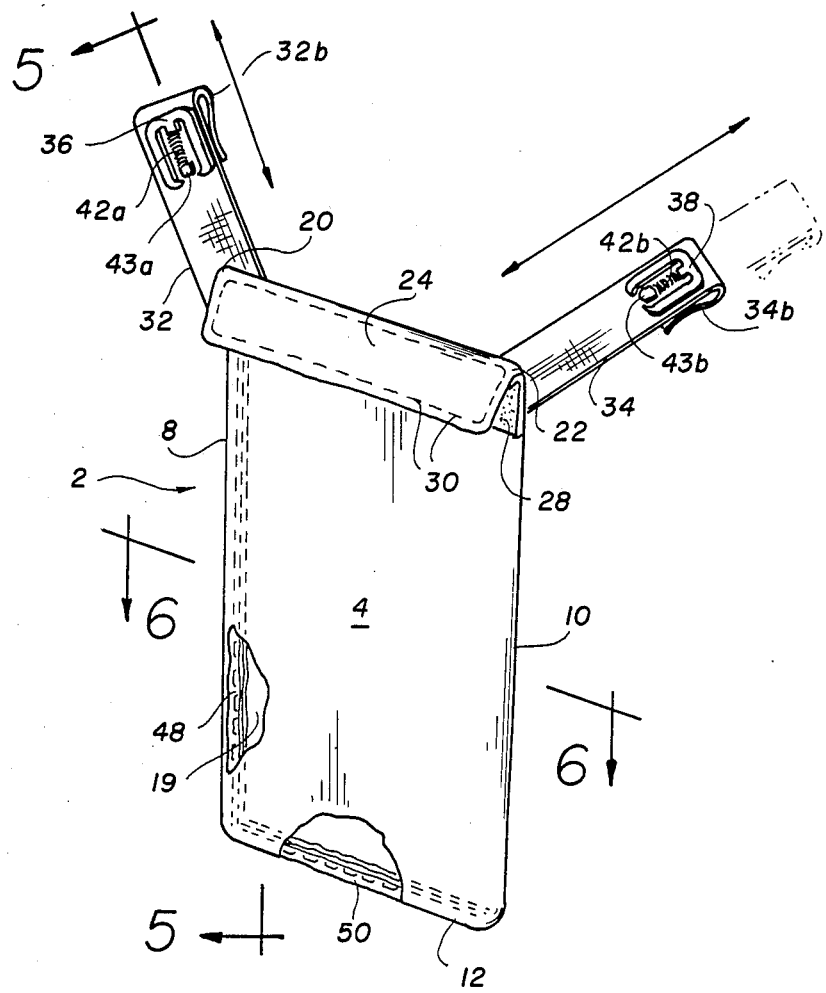
FIG. 1 is a perspective view of a security pouch embodying the present invention with end portions broken away to show construction details.
Figure 2:
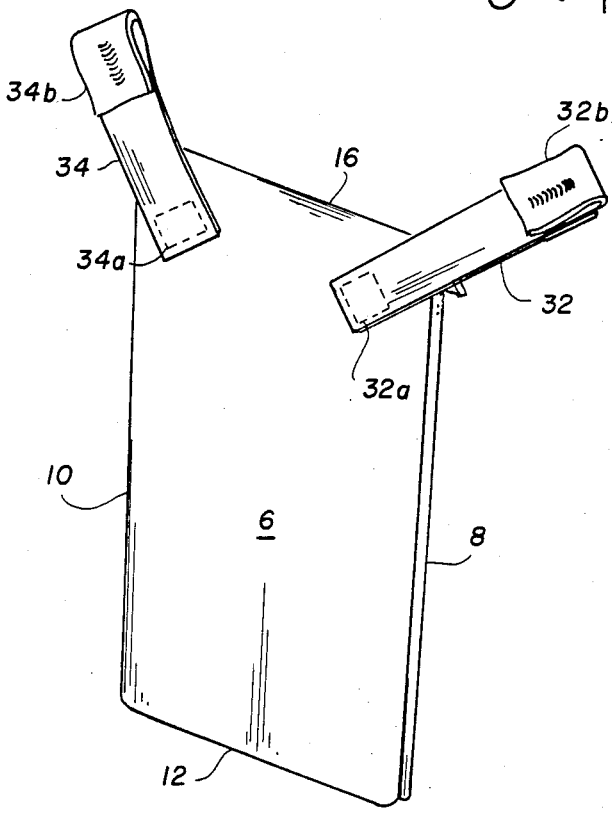
FIG. 2 is a rear view of the security pouch shown in FIG. 1.
Figure 5:
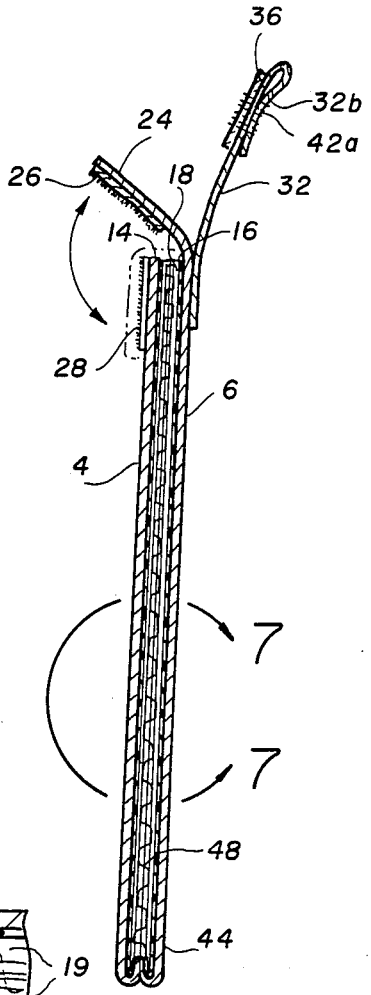
FIG. 5 is a vertical section taken along line 5—5 of FIG. 1, and shows the displacability of the flap member for releasably closing the access opening of the pouch.
Figure 7:
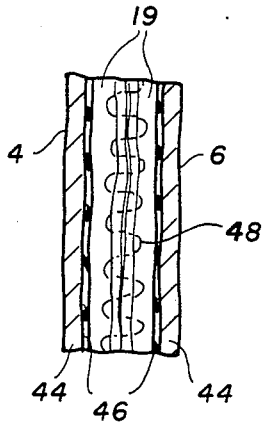
FIG. 7 is an enlarged detail view taken along line 7—7 of FIG. 5.
Figure 8:
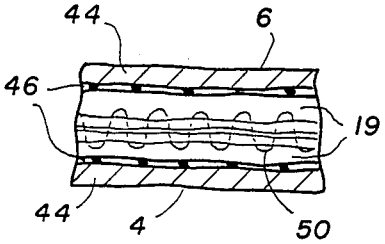
FIG. 8 is an enlarged detail view taken along line 8—8 of FIG. 6.
Figure 6:
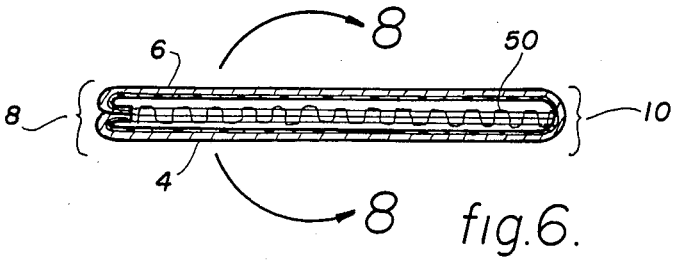
FIG. 6 is a horizontal section taken along line 6—6 of FIG. 1.

Referring now to the drawings and, in particular, to FIGS. 1, 2 and 5, there is shown a generally rectangular security pouch 2 having a front panel and a rear panel 6 which are peripherally joined at their oppositely disposed first and second side edges 8, 10 and at their bottom edges 12. The front and rear panels have upper edges 14, 16 that which leads into the compartment 19 defined by the pouch. In a preferred form, the upper edges of the front and rear panels are at substantially the same height and the lateral ends thereof merge with the upper ends of the first and second sides to form first and second corners 20, 22, respectively.

The upper edge 16 of the rear panel 6 defines a horizontal fold line. An upward extension of the rear panel beyond the fold line defines a flap member 24 which is adapted to pivot about the fold line so as to overlay the access opening 18 of the pouch and the upper end section yieldable hooks is adhesively secured to the inner side of the flap member 24 and a second Velcro strip 28 comprising semi-yieldable loops is adhesively secured to the upper end section of the front panel 4. The structural integrity of the adhesively secured Velcro strips 26, 28 can be further enhanced with stitches 30 joining the peripheral portion of each Velcro strip with its corresponding panel portion, as illustrated in FIG. 1 with respect to the flap member 24. By pressing the flap member 24 into engagement with the front panel, the yieldable hooks of the first Velcro strip engage the semi-yieldable loops of the second Velcro strip for releasably securing the flap member to the panel and thereby releasably enclosing the access opening 18 of the pouch. Although the mechanism for releasably closing the access opening has been particularly described and illustrated with respect to a flap member and cooperating Velcro strips, any other suitable closure mechanism can be used for this purpose as, for example, nap or zipper assemblies.

First and second support straps 32, 34 are secured by stitches 32*a*, 34*a* to the outer face of the rear panel at positions proximate to the first and second upper corners thereof 20, 22, respectively. The first and second support straps extend upwardly and outwardly beyond the fold line of the rear panel and, preferably, pass over the first and second upper corners 20, 22, respectively, of the pouch. The outer portion of each strap is folded back to provide enhanced first and second support bases 32*b*, 34*b* for first and second hooks 36, 38 that are secured thereto on the front faces thereof. The hooks are adapted to releasably engage a strap 40 of an upper torso undergarment as, for example, a brassiere strap wherein the first hook engages the strap on the rear side of the shoulder and the second hook engages the strap on the front side of the shoulder, whereby the pouch is suspended beneath the arm of a wearer, as illustrated in FIGS. 3 and 4. As shown in the drawings, an illustrative pair of hooks which can be used for this purpose comprise 3-prong hooks wherein each hook is secured to its respective support strap by stitching 42*a*, 42*b* disposed about the middle prong of the hook and extending through the folded portion of the support strap whereby the brassiere strap or the like passes under the outer prongs and over the middle prong of the hook to effect releasable attachment. The lower end of the middle prong of the hook is provided with oppositely disposed lateral projections 43*a*, 43*b* to prevent the hook from sliding away from the stitching. The inner edge of each outer prong is serrated and the lower end of each outer prong curves inwardly to more securely grip the undergarment strap. The support straps advantageously have an elastic construction to facilitate attachment of the security pouch to a brassiere strap and to provide for appropriate fit and comfortable wear during use.

The security pouch can be constructed from any suitable material as, for example, a fabric comprising natural or synthetic fibers or a blend thereof. A moderately or loosely woven fabric, such as cheesecloth, is well suited for this use. However, in a preferred form, the security pouch comprises a laminate having an outer layer of cheesecloth 44 and an inner layer of natural or synthetic rubber 46 or other water resistant material. The laminate is particularly advantageous because it enables the security pouch to maintain its shape and to provide a fluid impervious surface.

In an illustrative embodiment, the security pouch can be prepared from a rectangularly shaped fabric comprising a laminate in which one layer is cheesecloth and the other layer is rubber. The laminated fabric is measured into substantially equal longitudinal panels, with the border between the panels defining a vertical fold line. The upper end section of one panel, which is to become the front panel 4 of the pouch, is removed by appropriate excision and the residual cut line defines the upper edge 14 of the front panel. In the adjacent panel, which is to become the rear panel 6 of the pouch, a lateral line is disposed at substantially the same height as the upper edge 14 of the front panel and defines an upper edge 16 of the rear panel in the form of a horizontal fold line. The upward extension of the rear panel beyond the horizontal fold line 16 defines a flap member 24 that is pivotally displaceable about this fold line.

A first Velcro strip 26, comprising yieldable hooks, is adhesively secured and stitched to the rubber-side 46 of the flap member. A second Velcro strip 28, comprising semi-yieldable loops and dimensionally similar to the first Velcro strip, is adhesively secured and stitched to the upper end section of the cheesecloth-side 44 of the front panel 4.

First and second, oppositely disposed, elastic support straps 32, 34 are stitched to the cheesecloth side of the rear panel at respective positions adjacent to oppositely disposed vertical lines which will form the first and second sides 8, 10 of the pouch and at positions proximate to the horizontal fold line 16 of the rear panel. The first and second support straps extend upwardly and outwardly beyond the fold line of the rear panel and advantageously pass over the first and second corners 20, 22, respectively, that will be formed at the opposite ends of the horizontal fold line 16. The upper ends of the elastic straps are folded back toward the rear panel to provide support bases g for 3-prong hooks 36, 38 or the like which are sewn to the front faces thereof as hereinabove described.

The pouch precursor is folded along the vertical fold line so as to bring the cheesecloth surface of each panel into face-to-face relationship. The open side, opposite the vertical fold line, and the open bottom are closed by first and second stitching segments 48, 50. The resulting 3-side pocket is inverted to place the cheesecloth surfaces on the outside and the rubber surfaces and stitching seams on the inside. The flap member is then folded and pressed into releasable latching engagement with the front panel to thereby complete the formation of the security pouch.

While in the foregoing description and accompanying drawings, there has been shown and described the preferred embodiment of this invention, it will be understood, of course, that minor changes may be made in the details of construction as well as in the combination, arrangement and composition of parts, and steps of the method, without departing from the spirit and scope of the invention as claimed.

That which is claimed is:

1. A security pouch having an access opening and comprising means for attaching said pouch to a strap of an upper torso undergarment, said pouch being suspendable beneath the arm of a wearer to permit safe, inconspicuous and secure carrying of valuables;

said pouch having front and rear panels and first and second oppositely disposed peripheral sides, said front and rear panels having cooperatively aligned upper edges that defined said access opening; and the means for attaching said pouch to an undergarment strap comprises first and second oppositely disposed support straps secured to said rear panel proximate to the first and second peripheral sides, respectively, said support straps projecting upwardly and outwardly from said rear panel and terminating in upper end sections, with each upper end section having attachment means secured thereto for releasably attaching said pouch to a strap of said undergarment.

2. The security pouch of claim 1 which further comprises releasable closure means for said access opening.

3. The security pouch of claim 2 wherein the releasable closure means comprises a pivotally disposed flap member that extends from the upper edge of said rear panel and overlaps the upper edge of said front panel.

4. The security pouch of claim 3 wherein the upper edge of said rear panel defines a fold line, and said flap member comprises an extension of said rear panel beyond said fold line, with said flap member being folded about said fold line to overlap the upper edge of said front panel.

5. The security pouch of claim 4 wherein the inner side of said flap member comprises first latching means and the outer side of said front panel proximate to the upper edge thereof comprises second latching means, said first and second latching means being releasably interlatchable for releasably securing said flap to said front panel.

6. The security pouch of claim 5 wherein one of said latching means comprises yieldable hooks and the other of said latching means comprises yieldable loops for releasably securing said hooks.

7. The security pouch of claim 4 wherein the upper ends of said first and second peripheral sides terminate in first and second upper corners, respectively, and said first and second support straps cross said first and second upper corners, respectively.

8. The security pouch of claim 7 wherein said support straps have an elastic structure.

9. The security pouch of claim 4 wherein said pouch has an outer layer and an inner layer, said outer layer being cheesecloth and said inner layer being water repellant material.

10. The security pouch of claim 9 wherein the outer and inner layers comprise a laminated structure.

11. The security pouch of claim 4 wherein the upper edge of said rear panel is substantially in planar alignment with the upper edge of said front panel.

* * * * *